US010421074B2

(12) United States Patent
Norrman et al.

(10) Patent No.: US 10,421,074 B2
(45) Date of Patent: Sep. 24, 2019

(54) FOLDABLE MICROPLATE

(71) Applicant: GE Healthcare Bio-Sciences AB, Uppsala (SE)

(72) Inventors: Nils Norrman, Uppsala (SE); Henrik Ostlin, Uppsala (SE)

(73) Assignee: GE Healthcare Bio-Sciences AB, Uppsala (SE)

( * ) Notice: Subject to any disclaimer, the term of this patent is extended or adjusted under 35 U.S.C. 154(b) by 497 days.

(21) Appl. No.: 15/101,234

(22) PCT Filed: Nov. 25, 2014

(86) PCT No.: PCT/EP2014/075567

§ 371 (c)(1),
(2) Date: Jun. 2, 2016

(87) PCT Pub. No.: WO2015/086313

PCT Pub. Date: Jun. 18, 2015

(65) Prior Publication Data

US 2016/0303561 A1 Oct. 20, 2016

(30) Foreign Application Priority Data

Dec. 13, 2013 (GB) ..... 1322082.7

(51) Int. Cl.
*B01L 3/00* (2006.01)

(52) U.S. Cl.
CPC ... *B01L 3/50855* (2013.01); *B01L 2300/0829* (2013.01)

(58) Field of Classification Search
CPC ..... B01L 3/5055; B01L 3/50822; B01L 2300/0829; B01L 3/5085; B01L 3/50855
See application file for complete search history.

(56) References Cited

U.S. PATENT DOCUMENTS 3,186,556 A * 6/1965 Forsstrom ..... B01L 9/06 211/74
4,925,630 A 5/1990 Grunwald
8,647,593 B2 2/2014 Yin et al.
(Continued)

FOREIGN PATENT DOCUMENTS

CN 102710359 A 10/2012
WO 03/049861 A1 6/2003
(Continued)

OTHER PUBLICATIONS

CN Office Action for CN Application No. 201480067379.6 dated Apr. 17, 2014 (English translation, 12 pages).
(Continued)

*Primary Examiner* — Jill A Warden
*Assistant Examiner* — Dwayne K Handy
(74) *Attorney, Agent, or Firm* — Eversheds Sutherland (US) LLP

(57) ABSTRACT

The present invention provides a microplate comprised of multiwell strips connected in such a way as to permit the microplate to unfold and to pass in a linear fashion past a fraction collector and then re-fold back into a microplate configuration. Furthermore, the invention provides for the use of the microplates of the invention in a variety of different laboratory methods.

20 Claims, 5 Drawing Sheets

(56) References Cited

U.S. PATENT DOCUMENTS

| | | | | |
|---|---|---|---|---|
| 2003/0064508 | A1 | 4/2003 | Kwasnoski et al. | |
| 2015/0101911 | A1* | 4/2015 | Friedman ..... | G01N 35/04<br>198/617 |

FOREIGN PATENT DOCUMENTS

| | | | |
|---|---|---|---|
| WO | 2009/040082 | A | 4/2009 |
| WO | 2013/184306 | A1 | 12/2013 |

OTHER PUBLICATIONS

International Search Report and Written Opinion regarding International Application No. PCT/EP2014/075567, dated Jun. 1, 2015, 8 pages.
GB Search Report regarding GB Application No. 1322082.7, dated Jun. 2, 2014, 3 pages.

* cited by examiner

FOLDABLE MICROPLATE

CROSS-REFERENCE TO RELATED APPLICATIONS

This application is a filing under 35 U.S.C. 371 of international application number PCT/2014/075567, filed Nov. 25, 2014, which claims priority to GB application number 1322082.7, filed Dec. 13, 2013, the entire disclosures of each of which are hereby incorporated by reference.

TECHNICAL FIELD OF THE INVENTION

The present invention relates to the field of disposables for laboratories, e.g. for chemical and biological laboratories. Particularly the invention provides a microplate comprised of multiwell strips connected in such a way as to permit the microplate to unfold and to pass in a linear fashion past a fraction collector and then re-fold back into a microplate configuration. Furthermore, the invention provides for the use of the microplates of the invention in different methods.

DESCRIPTION OF RELATED ART

A convenient feature of commercially-available liquid chromatography systems is the provision of a fraction collection valve located in the liquid flow line immediately after the detector. Collection can be done when peaks appear on the chromatogram recorded by the detector, enabling specific components of the chromatography to be collected for further assessment. Known fraction collectors use standard test tubes, e.g. Eppendorf tubes, arranged to allow them to pass substantially linearly past the fraction collection valve. Following fraction collection the fractions are typically transferred into a microplate (or another device) for further processing or analysis. This transfer can be carried out manually or more conveniently, in particular where there are a large number of fractions, using an automated system.

A disadvantage of the known system is that there are multiple stages involved in fraction collection and subsequent processing. There is therefore a need for a simpler process that overcomes this disadvantage.

SUMMARY OF THE INVENTION

In one aspect the present invention provides a microplate (1) comprising a plurality multiwell strips (2) wherein each of said plurality of multiwell strips (2) is connected to the adjacent multiwell strip (2') by means of a coupler (3) wherein said coupler (3) comprises at least two pivots allowing pivoting between adjacent strips.

In one embodiment of said microplate (1) the pivots of said coupler (3) comprise two substantially C-shaped or O-shaped outer clamp members (4, 4') which are interconnected back-to-back at a linkage (5).

In another embodiment of the microplate (1) each clamp member (4, 4') cooperates with a complementary formation at each end of each strip (2, 2') to provide said pivoting.

In one embodiment of the microplate (1) of the invention each of said multiwell strips (2) comprises a frame (7) that supports a plurality of wells (8).

In one embodiment of the microplate (1) of the invention said frame comprises an upper surface supported by legs and wherein said upper surface comprises a plurality of holes therethrough for receipt of said plurality of wells.

In one embodiment of the microplate (1) of the invention said frame (7) comprises two opposing longitudinal side walls (9, 9') each having an upper edge (10, 10') and a lower edge (11, 11') wherein said longitudinal side walls (9, 9') are connected by two opposing end walls (12, 12') each having an upper edge (13, 13') and a lower edge (14, 14').

In one embodiment of the microplate (1) of the invention said upper edges (10, 10', 13, 13') are aligned.

In one embodiment of the microplate (1) of the invention said lower edges (11, 11', 14, 14') are aligned.

In one embodiment of the microplate (1) of the invention each of said wells (8) comprises a top end (15) defining an opening (16) and a bottom end (17) defining a base (18).

In one embodiment of the microplate (1) of the invention the bottom end (17) of said wells (8) protrudes below the lower edges (11, 11', 14, 14') of said frame.

In one embodiment of the microplate (1) of the invention said base is U-shaped, V-shaped or flat.

In one embodiment of the microplate (1) of the invention each of said multiwell strips (2) comprises 2 to 64 wells, preferably 4 to 32 wells, more preferably 6 to 8 wells.

In one embodiment of the microplate (1) of the invention said coupler (3) is formed integrally as one piece.

In another aspect the present invention provides for the use of the microplate (1) of the invention in research procedures and diagnostic techniques.

In one embodiment of the use of the invention the research procedure and/or diagnostic technique is selected from the group consisting of genetic typing, amplification of nucleic acids, polymerase chain reaction (PCR) based methods, enzyme-linked immunosorbent assay (ELISA), sequencing, high content screening, crystallography, melt curve determination, hybridisation related assays, in vitro translation, in vitro transcription, cell culturing, liquid handling systems, storage of samples and storage of compounds.

DETAILED DESCRIPTION OF THE PREFERRED EMBODIMENTS

Figure 1:
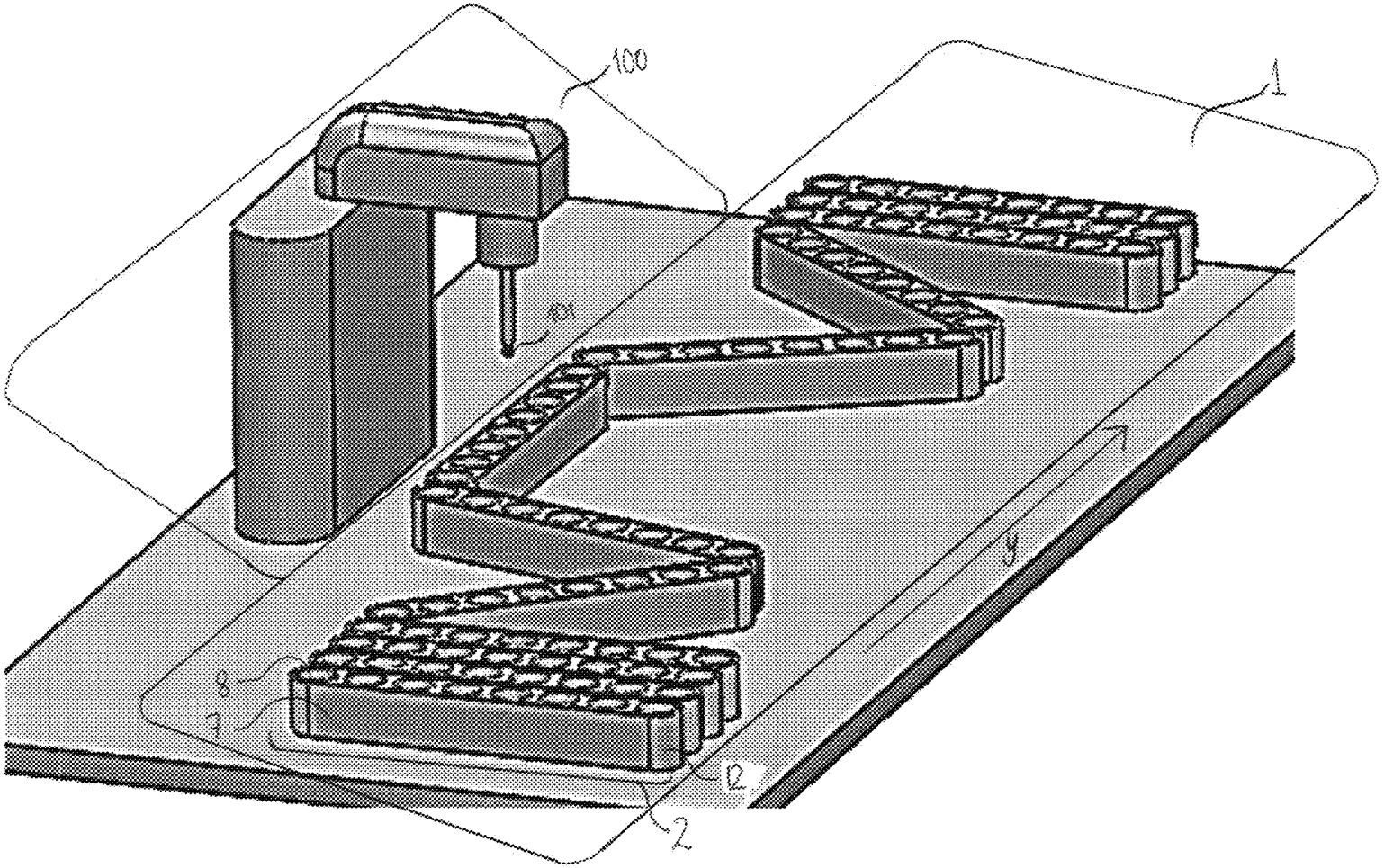
FIG. 1 illustrates a microplate of the invention in use for fraction collection in a linear direction.

FIG. 1 shows a microplate 1 of the invention in a partially unfolded state while being used to collect fractions from a fraction collector device 100. Linear movement of the microplate wells 8 underneath the outlet 101 of the fraction collector device 100 is achieved as each multiwell strip 2 of the microplate 1 moves in direction "y". Motion may be achieved in a straightforward manner, e.g. having a single drive wheel close to the outlet 101 of the fraction collector device 100. It is furthermore useful to have retaining walls placed around the strips to guide movement in the desired direction and to enable folding back to the original microplate format.

Figure 2:
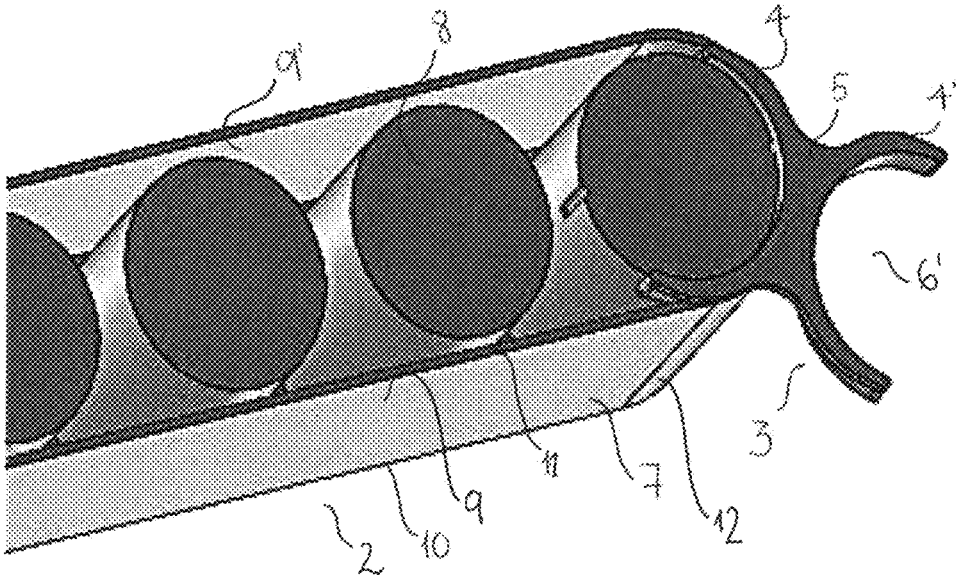
FIG. 2 shows a partial underside view of part of a multiwell strip with a coupler attached.

FIG. 2 shows a partial view of the underside of a multiwell strip 2 of the microplate 1 of the invention with a coupler 3 attached at one end. The coupler 3 can be seen to include two C-shaped outer clamp members 4 and 4' with respective open mouths 6 and 6' connected at linkage 5. The underside of a number of wells (one of which is indicated as 8) can be seen as well as the frame 7 of the multiwell strip 2 which is comprised of two side walls 9 and 9' and two end walls (one of which can be seen in FIG. 2 as 12). The upper edge 10 and the lower edge 11 of one of the side walls 9 are also indicated in FIG. 2.

Figure 3:
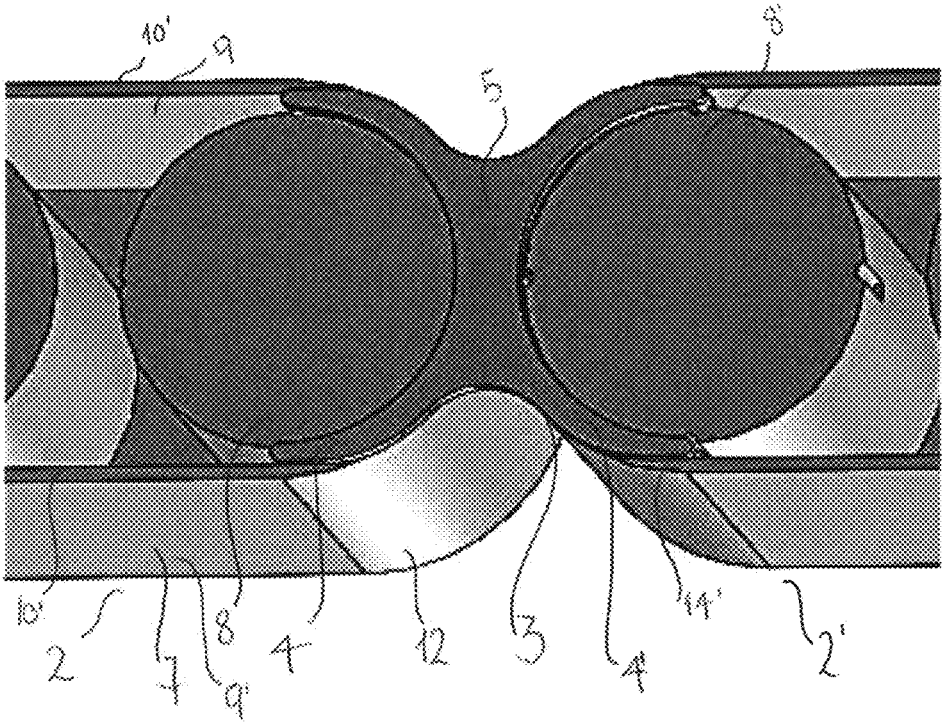
FIG. 3 is a partial underside view of how two multiwell strips are connected together with a coupler showing the multiwell strips aligned linearly.
Figure 4:
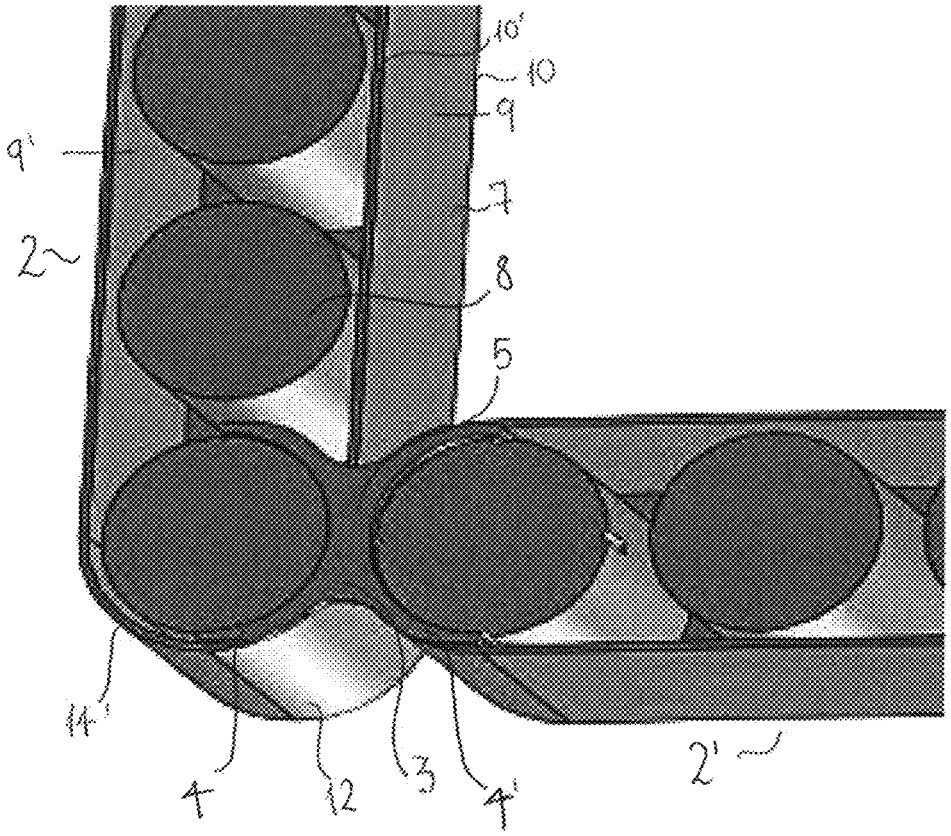
FIG. 4 is another partial underside view of two multiwell strips connected together with a coupler showing the multiwell strips at right angles to each other.

FIG. 3 is an underside view of two multiwell strips 2 and 2' of a microplate according to the present invention connected with a coupler 3 in an end-to-end linear relationship. It can be seen how each clamp member 4 and 4' of the coupler 3 snap fits around the outside of each end well 8 and 8' of each multiwell strip 2 and 2' so as to connect the multiwell strips together. In this arrangement, the multiwell strips 2 and 2' can move in a hinge-like fashion relative to each other, i.e. can be in the illustrated end-to-end linear arrangement, in a parallel side-by-side arrangement, and anywhere in between these two extremes. In FIG. 4 the two multiwell strips 2 and 2' can be seen arranged half way between the end-to-end linear arrangement and the side-by-side parallel arrangement. The connected multiwell strips can therefore either be folded together all in a side-by-side arrangement to form a microplate that can be used in a variety of standard laboratory procedures, or they can be unfolded in order to pass by a fraction collection device or other device from which samples are dispensed.

Figure 5:
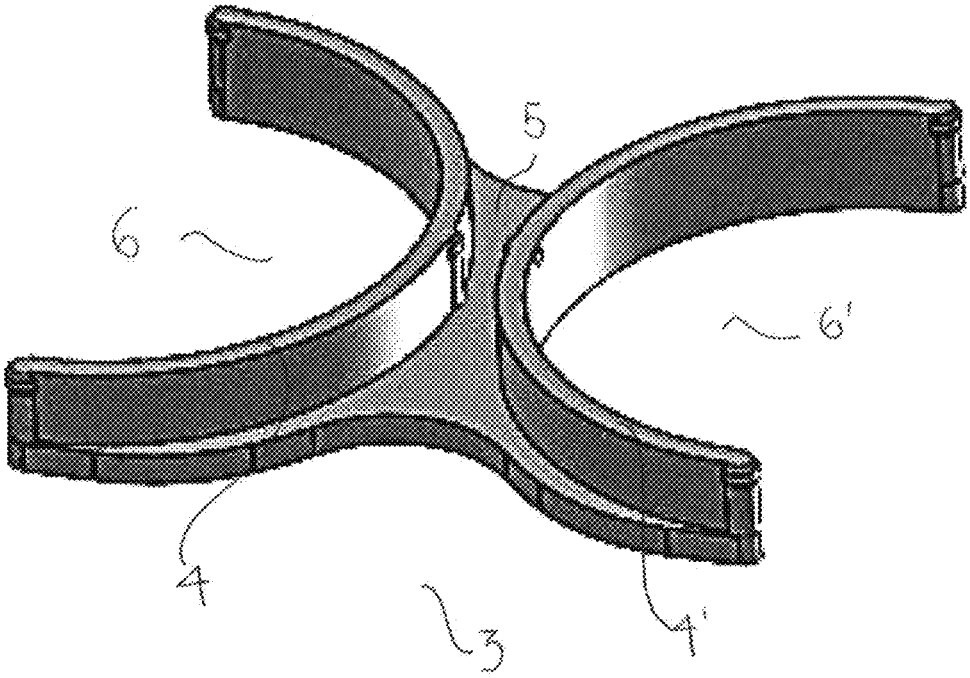
FIG. 5 shows a coupler suitable for use with the present invention to connect two multiwell strips together.

The skilled person will recognise that a variety of coupler configurations are suitable for use in the present invention as long as they comprise at least two pivots allowing pivoting between adjacent strips. A C-shaped clamp member can snap fit onto the end of a multiwell strip, whereas for example an O-shaped clamp member can provide a more permanent coupling arrangement. A coupler 3 is illustrated on its own in FIG. 5 in order to more clearly show two C-shaped outer clamp members 4 and 4', having open mouths 6 and 6', interconnected at linkage 5. As can be seen, the illustrated coupler 3 is formed integrally as one piece.

Microplates and microwells are well known and widely used in the field of life sciences. A "microplate" (also commonly known as a "microtitre plate" or "microwell plate") is a flat plate with multiple "wells" used as small test tubes. The microplate has become a standard tool in analytical research and clinical diagnostic testing laboratories. The microplate according to the present invention is designed for the use in a variety of well-known systems. These systems have standard dimensions for the measurements of multiwell strips with respect to e.g. the distance between the wells, the dimensions or design of the wells. The skilled person is aware of the standards, which can be found e.g. at: http://www.slas.org/default/assets/File/ANSI_SLAS_1-2004_FootprintDimensions.pdf) and which govern various characteristics of a microplate. In one embodiment of the microplate of the present invention the spacing of the wells meet(s) the standards prescribed by the American National Standards Institute (ANSI). In another embodiment the spacing of one well to another with respect to the centre of the wells is selected from the group consisting of 9 mm, 4.5 mm and 2.25 mm. In another embodiment of the microplate of the present invention the spacing of the well positions is the spacing according to the spacing for 96-well microplates as set out by ANSI and wells with a total volume of 50 μL. In another embodiment the wells have a total height of about 7.35±0.1 mm and a maximum inner diameter of about 3.25±0.1 mm.

Microplates are manufactured in a variety of materials. The most common is polystyrene, used for most optical detection microplates. It can be coloured white by the addition of titanium dioxide for optical absorbance or luminescence detection or black by the addition of carbon for fluorescent biological assays. Polypropylene is used for the construction of plates subject to wide changes in temperature, such as storage at −80° C. and thermal cycling. It has excellent properties for the long-term storage of novel chemical compounds. Polycarbonate is cheap and easy to mould and has been used for disposable microplates for the polymerase chain reaction (PCR) method of deoxyribonucleic acid (DNA) amplification. Cyclo-olefins are now being used to provide microplates which transmit ultraviolet light for use in newly developed assays. There are also microplates constructed from solid pieces of glass and quartz for special applications.

The frame of a multiwell strip can consist of a first material and the wells can consist of a second material. The materials of the multiwell strip may vary and can be adapted to the needs, e.g. thermal resistant, thermal diffusivity or rigidity of the material. For example the first material may selected from the group comprising amorphous plastic partially crystallizing, polycarbonate (PC), cycloolefin copolymer (COC; Topas™ COC), acrylonitrile butadiene styrene (ABS), acetyl copolymer (Delrin), nylon, filled polymers, glass filled polymers, talc filled polymer, cycloolefin polymer (COP). The second material may be for example selected from the group comprising of polypropylene (PP), polyethylene (PE) and polycarbonate (PC). The skilled artisan will recognize that any combinations of first and second material can be used according to the needs and the purposed use of the microplate of the invention. In one embodiment of the present invention the first material is polycarbonate (PC) and the second material is polypropylene (PP). In another embodiment the first material is cycloolefin copolymer (COC; Topas™ COC) and the second material is polypropylene (PP), and in a further embodiment the first material is cycloolefin polymer (COP) and the second material is polypropylene (PP).

In one embodiment of the present invention, the multiwell strip comprises 2 to 64 wells, preferably 4 to 32 wells, more preferably 6 to 8 wells. In a further embodiment of the present invention the spacing of the well positions corresponds to microplates as set out by ANSI and wells with a total volume of 50 μL. In another embodiment the wells have a total height of about 7.35±0.1 mm and a maximal inner diameter of about 3.25±0.1 mm. A microplate can have 6, 24, 96, 384 or even 1536 sample wells arranged in a 2:3 rectangular matrix. Some microplates have even been manufactured with 3456 or even 9600 wells. In one embodiment of the present invention, the microplate comprises 6 to 1536 wells, preferably 6 to 384 wells. In a further preferred embodiment the microplate according to the present invention has 96 wells.

The enclosed Figures show wells having a flat bottom, but wells can also be U-shaped or V-shaped. A flat bottom well type is ideal for precise optical measurements and for microscopic applications. The measuring light source is not deflected by the well profile. Excellent optical properties as a result of the flat bottom of the wells. U-shaped bottom well are ideally suited for agglutination tests as they have no sharp corners, meaning they can be pipetted easily and cleanly. A V-shaped (also referred to as "conical") bottom well is ideally suited for applications in which the entire sample volume must be pipetted off. Precise pipetting is facilitated since the sample collects particularly well at the bottom. These wells are also ideally suited for the storage of samples.

Each well of a microplate typically holds somewhere between tens of nanoliters to several milliliters of liquid. They can also be used to store dry powder or as racks to support glass tube inserts. Microplates can be stored at low temperatures for long periods, may be heated to increase the rate of solvent evaporation from their wells and can even be heat-sealed with foil or clear film. Another microplate sealing method involves use of dedicated microplate covers, typically made from silicone rubber and useful where samples are to be added or taken out using needle penetration as the material reseals when the needle is removed. Microplates with an embedded layer of filter material were developed in the early 1990s by several companies, and today, there are microplates for just about every application in life science research which involves filtration, separation, optical detection, storage, reaction mixing or cell culture.

It will be acknowledged by those with ordinary skills in the art that the microplate and/or multiwell strips according to the present invention can be used in many different laboratory applications. For example, the multiwell strip or microplate may be used for storage of compounds or samples or may be used in research procedures and/or diagnostic techniques. Microplates are used generally in different types of liquid handling systems, in particular robotic systems, designed to perform multiple iterations of applications and/or analyses. Various biological research and clinical diagnostic procedures and techniques require or are facilitated by an array of wells or tubes in which multiple samples are disposed for qualitative and quantitative assays or for sample storage and retrieval. The term "sample" as used herein refers to any kind of substance or substance mixture to be analysed. A sample may be a sample originating from an environmental source, such as a plant sample, a water sample, a soil sample, or may be originating from a household or industrial source or may also be a food or beverage sample. A sample in the meaning of the invention may also be a sample originating from a biochemical or chemical reaction or a sample originating from a pharmaceutical, chemical, or biochemical composition. A sample may also be a forensic or medical sample such as bodily fluids or tissue samples.

The present invention is advantageous because it omits manual stages when moving from "linear" collection (along x axis only) or processing of samples to further processing or analysis in a standard microplate format (xy processing). Furthermore, the present invention provides the link between a number of common lab operations with the well-established microplate format for rapid and efficient analysis.

Particular advantages are to be gained for sample transfer. A number of companies have developed robots to specifically handle microplates. These robots may be liquid handlers which aspirate or dispense liquid samples from and to these plates, or "plate movers" which transport them between instruments, plate stackers which store microplates during these processes, plate hotels for longer term storage, plate washers for processing plates, plate thermal sealers for applying heat seals, de-sealers for removing heat seals, or microplate incubators to ensure constant temperature during testing. Instrument companies have designed plate readers which can detect specific biological, chemical or physical events in samples stored in these plates.

The invention claimed is:

1. A microplate comprising a first multiwell strip comprising a plurality of first microwells each having a volume of 50 μL and a second multiwell strip comprising a plurality of second microwells each having a volume of 50 μL, wherein the first multiwell strip is connected to the second multiwell strip by a coupler defining a first pivot and a second pivot configured to allow the first multiwell strip and the second multiwell strip to pivot relative to one another.

2. The microplate as defined in claim 1, wherein the coupler comprises a first clamp member and a second clamp member interconnected by a linkage, wherein the first clamp member is connected to the first multiwell strip, and wherein the second clamp member is connected to the second multiwell strip.

3. The microplate as defined in claim 2, wherein the first clamp member is configured to pivot relative to the first multiwell strip, and wherein the second clamp member is configured to pivot relative to the second multiwell strip.

4. The microplate as defined in claim 1, wherein the first multiwell strip further comprises a first frame that surrounds the plurality of first microwells, and wherein the second multiwell strip further comprises a second frame that surrounds the plurality of second microwells.

5. The microplate as defined in claim 4, wherein the first frame comprises an upper surface comprising a plurality of first holes therethrough for receipt of the plurality of first microwells, and wherein the second frame comprises an upper surface comprising a plurality of second holes therethrough for receipt of the plurality of second microwells.

6. The microplate as defined in claim 4, wherein the first frame comprises two opposing longitudinal side walls connected by two opposing end walls, and wherein the second frame comprises two opposing longitudinal side walls connected by two opposing end walls.

7. The microplate as defined in claim 2, wherein the first clamp member is connected to one of the first microwells, and wherein the second clamp member is connected to one of the second microwells.

8. The microplate as defined in claim 7, wherein the first clamp member and the second clamp member each have a C-shape or an O-shape.

9. The microplate as defined in claim 4, wherein the first microwells and the second microwells each comprise a top end defining an opening and a bottom end defining a base.

10. The microplate as defined in claim 9, wherein the bottom ends of the first microwells protrude below a lower edge of the first frame, and wherein the bottom ends of the second microwells protrude below a lower edge of the second frame.

11. The microplate as defined in claim 9, wherein the base is U-shaped, V-shaped, or flat.

12. The microplate as defined in claim 1, wherein the first multiwell strip comprises 2 to 64 of the first microwells, and wherein the second multiwell strip comprises 2 to 64 of the second microwells.

13. The microplate as defined in claim 2, wherein the first clamp member, the second clamp member, and the linkage are integrally formed with one another.

14. A method of using the microplate as defined in claim 1, the method comprising:

pivoting the first multiwell strip and the second multiwell strip relative to one another from a first configuration to a second configuration; and performing a research procedure or diagnostic technique using the microplate while the first multiwell strip and the second multiwell strip are in the second configuration.

15. The method as defined in claim 14, wherein the research procedure or diagnostic technique is selected from the group consisting of: genetic typing, amplification of nucleic acids, polymerase chain reaction (PCR) based methods, enzyme-linked immunosorbent assay (ELISA), sequencing, high content screening, crystallography, melt curve determination, hybridisation related assays, in vitro translation, in vitro transcription, cell culturing, liquid handling systems, storage of samples, and storage of compounds.

16. The method as defined in claim 14, wherein the first multiwell strip and the second multiwell strip are oriented at an angle relative to one another when the first multiwell strip and the second multiwell strip are in the first configuration, and wherein the first multiwell strip and the second multiwell strip are oriented parallel to one another when the first multiwell strip and the second multiwell strip are in the second configuration.

17. A microplate comprising a first multiwell strip comprising a plurality of first microwells and a second multiwell strip comprising a plurality of second microwells, wherein the first multiwell strip is connected to the second multiwell strip by a coupler defining a first pivot and a second pivot configured to allow the first multiwell strip and the second multiwell strip to pivot relative to one another, wherein the coupler comprises a first clamp member and a second clamp member interconnected by a linkage, wherein the first clamp member is connected to one of the first microwells and configured to pivot relative to the first multiwell strip, and wherein the second clamp member is connected to one of the second microwells and configured to pivot relative to the second multiwell strip.

18. The microplate as defined in claim 17, wherein the first microwells each have a volume of 50 μL, and wherein the second microwells each have a volume of 50 μL.

19. A microplate comprising a first multiwell strip comprising a plurality of first microwells and a second multiwell strip comprising a plurality of second microwells, wherein the first multiwell strip is connected to the second multiwell strip by a coupler defining a first pivot and a second pivot configured to allow the first multiwell strip and the second multiwell strip to pivot relative to one another, wherein the coupler comprises a first clamp member and a second clamp member interconnected by a linkage, wherein the first clamp member is connected to one of the first microwells and configured to pivot relative to the first multiwell strip, wherein the second clamp member is connected to one of the second microwells and configured to pivot relative to the second multiwell strip, wherein the first pivot has a first central axis that is coaxial with the one of the first microwells, and wherein the second pivot has a second central axis that is coaxial with the one of the second microwells.

20. The microplate as defined in claim 19, wherein the first microwells each have a volume of 50 μL, and wherein the second microwells each have a volume of 50 μL.

* * * * *